United States Patent [19]

Sipin

[11] 4,056,426

[45] Nov. 1, 1977

[54] PAPER SALVAGING MACHINE WITH IMPROVED SPLICING BOARD

[75] Inventor: Richard F. Sipin, Naperville, Ill.

[73] Assignee: American Tara Corporation, Chicago, Ill.

[21] Appl. No.: 784,421

[22] Filed: Apr. 4, 1977

[51] Int. Cl.[2] ..... B31F 5/00

[52] U.S. Cl. ..... 156/505

[58] Field of Search ..... 156/502, 505, 506, 157, 156/159

[56] References Cited

U.S. PATENT DOCUMENTS

| | | | |
|---|---|---|---|
| 2,664,139 | 12/1953 | Speed et al. | 156/505 |
| 3,382,131 | 5/1968 | Morganroth | 156/505 |
| 3,709,759 | 1/1973 | Hyca | 156/506 |

*Primary Examiner*—Douglas J. Drummond
*Attorney, Agent, or Firm*—Barry L. Clark

[57] ABSTRACT

Machine for salvaging rolls of paper such as printed business forms having pin feed registration holes along at least one edge includes guide rollers for positioning the paper web over a normally retracted splicing board. The free ends of the paper which are to be spliced are separately and selectively engaged by spaced vacuum tables. A pair of pin bars, each containing at least four spaced perforation engaging pins, are mounted on a splicing bar with a dovetail arrangement that permits rapid and accurate alignment with the paper. A hand actuated lever permits the pin bars to be moved vertically into or out of the web path so that a tape splice can be made very quickly.

11 Claims, 6 Drawing Figures

PAPER SALVAGING MACHINE WITH IMPROVED SPLICING BOARD

BACKGROUND OF THE INVENTION

The invention relates to salvaging machines for web materials having punched holes along at least one edge such as continuous business forms. More particularly, the invention relates to an improved splicing arrangement for quickly and accurately performing splices on a web which will not interfere with the usefulness of the printed forms adjacent the splice.

Business forms of the continuous type used in computer processing are generally assembled in very large and expensive collators which feed together, from a series of supply rolls, the paper and carbon paper which will make up the individual parts of the completed forms, fasten the various sheets together and then perforate and deliver the finished forms, usually in a fan-fold arrangement. Because of the very high capacity and cost of the collators a tremendous expense is involved when the collator must be stopped in order to cut a bad portion out of a supply roll and splice the resulting ends together again. It is most desirable to be able to supply only perfect supply rolls to a collator. However, it is quite common for the printed supply rolls to not be perfect due either to defects in the paper or unevenness or other problems with the printing on the paper. These defects are usually noted when the supply roll is printed and the printer will insert "printer's flags" into the web as it is being wound to indicate the areas of bad material which should later be removed from the roll. It is the purpose of salvage machines, which are quite inexpensive compared to collators, to permit repair of printed rolls by splicing out the bad materials. Such machines can also splice together a number of short or "butt" rolls into a larger roll usable on a collator. Since the continuous web fed to a collator comprises a series of individual forms which are ultimately perforated crosswise on a line defining their respective top and bottom edges, it is very important that the splice be made on the precise line which separates two forms. This is done so that the forms will remain in register and so that there will be no chance for the splice to interfere with the material being printed on the form as the form later passes through a computer printer. For this reason, and also from an esthetic desire not to have a splice appear on the face of a form, it is preferable that the splice be applied to the back surface of the form.

Although I am not aware of any patents disclosing salvage machines for edge perforated paper webs which include vacuum splicing tables, the following United States patents have been noted which relate to various splicing arrangements for films and other types of web material: U.S. Pat. Nos. 1,781,200; 2,213,744; 2,664,139; 2,711,782; 2,740,461; 3,447,994; 3,709,759; 3,773,598 and 3,957,567. U.S. Pat. No. 3,776,795 shows a paper punching arrangement for splicing together the last set of business forms in a fan-fold stack passing through a computer printer to the first form in a new stack so as to eliminate down time of the printer.

SUMMARY OF THE INVENTION

It is an object of the present invention to provide a paper salvaging machine which includes an integral splicing arrangement capable of very quickly and accurately splicing the resulting ends together when a section of bad material is removed.

This object and others are achieved by the machine of the present invention which includes a pair of support shaft members which may be utilized to support either the core of a supply roll or the core of a takeup roll. A pair of guide rolls in the machine cause the paper web to move in a straight line path above a splicing board means which is normally positioned just beneath the path of the paper. The splicing board means includes a pair of elongated vacuum box portions which extend across the width of the paper and are spaced from each other on opposite sides of the intended spliced line. The splice bar which contains the splicing groove and a pair of pin bars carried thereby are adapted to be moved into and out of the web path. When a splice is to be made, a lever is actuated to move the pin bar and its registration pins into contact with the holes along the edge of the web. Depending upon what part of the splicing operation is taking place the front and/or rear vacuum box can be selectively activated to hold the paper web in a fixed location.

DESCRIPTION OF THE PREFERRED EMBODIMENT

Figure 1:
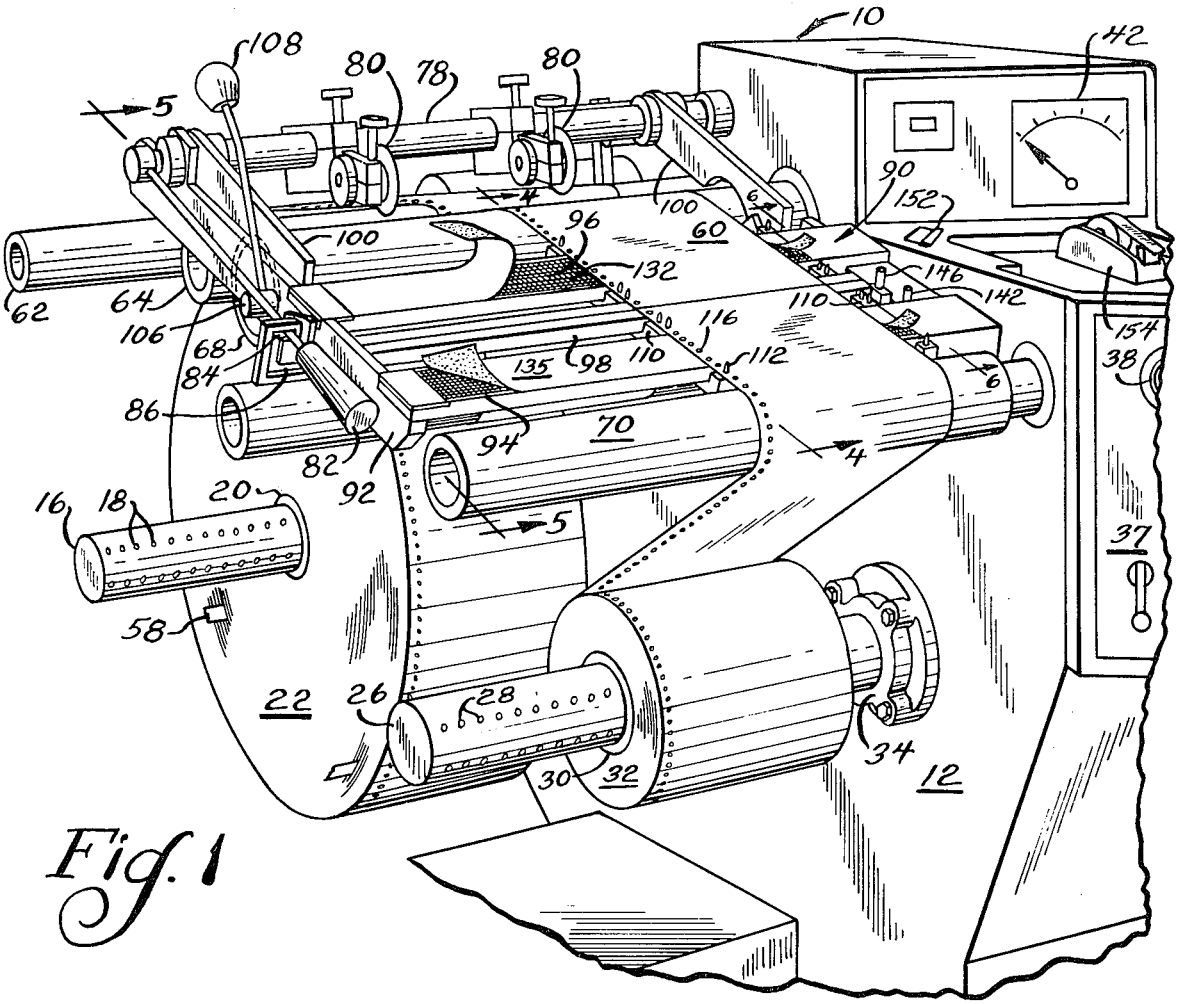
FIG. 1 is a perspective view of a fragmentary portion of the improved salvage machine.
Figure 2:
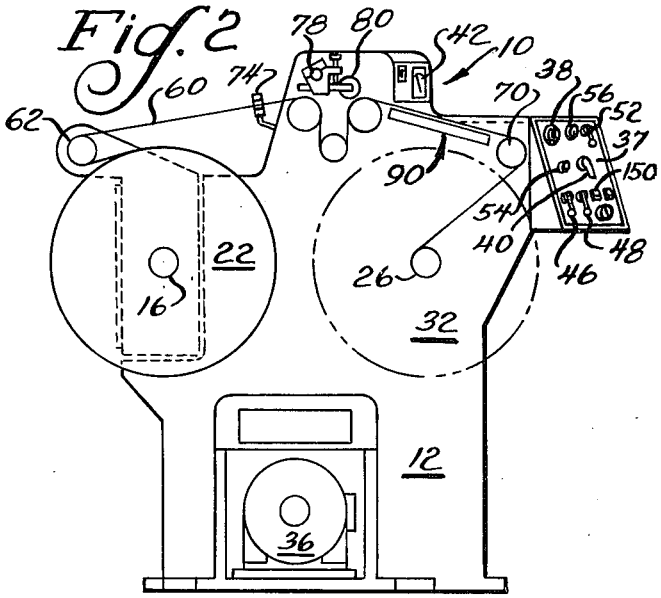
FIG. 2 is a somewhat schematic end view of the machine shown in FIG. 1 illustrating the path taken by the paper web.

Referring to FIG. 1, the salvage machine is indicated generally at 10 and includes a frame portion 12 in which is mounted a supply or unwind air shaft 16 which includes a plurality of air actuated retaining buttons 18 which are adapted to positively engage and retain the core 20 of a supply roll of paper 22. The frame 12 also supports a winding or take-up air shaft 26 having air actuated buttons 28 which engage and retain the core 30 of a take-up roll 32. The take-up air shaft 26 is mounted by means of bearing 34 in the frame 12 and the unwinding or supply roll shaft 16 would also be mounted in a similar manner. Although the shafts 16, 26 have been referred to as unwinding and take-up shafts respectively, their functions may be reversed depending upon the direction of rotation of the motor 36 (FIG. 2). Control of the machine 10 takes place from the control panel 37 which includes a motor speed control potentiometer 38 for varying the motor speed. The direction of rotation of the motor is controlled by varying the position of the forward or reverse selector switch 40. A speed indicator dial 42 indicates the speed of the motor. The switch 46 on the control panel 37 actuates the front air shaft lock which causes the buttons 28 to move outwardly against the core 30 to lock the core to the shaft during machine operation. Similarly, a control switch 48 operates the rear air shaft lock which causes the buttons 18 to engage core 20. A brake tension control switch control 52 turns the tension on or off to whichever of the shafts 16, 26 is performing the function of the supply roll shaft. The amount of tension provided is adjusted by adjusting knob 54 and the amount of tension being applied is shown by the indicator dial 56.

Assuming for the sake of description that the roll 22 is the supply roll of printed business forms paper which includes some sub-standard or imperfect printed areas at the locations indicated by printer's flags 58, the threading of the machine to permit the removal of the bad areas can be described as follows. Referring to FIGS. 1 and 2, the supply roll 22 which is wound about the core 20 is slipped onto the air shaft 16. Since the printing is on the outer surface of the roll and since it is most desirable to perform splicing of the roll on the bottom or unprinted side of the paper, the roll is mounted as shown in FIG. 2 so that the web 60 will pass over the idler rolls 62, 64, the tension roll 66, the anvil roll 68, the idler roll 70 and then onto the core 30 which is placed on the front air shaft 26. Although it is not shown in the drawings, the tension roll 66 is preferably mounted on a pivot arm in the manner of a dancer roll so that a very small movement upwardly of the tension roll 66 would cause the pivot arm to contact a force transducer which would in turn control the brake tension applied to the supply shaft 16 by the brake mechanism (not shown). A web guide 74 is preferably provided for sensing the edge position of the web 60 and causing the unwinding air shaft 16 to be moved in or out relative to the frame 12 as necessary to maintain the web in perfect alignment with the core being wound on shaft 26.

Since it is sometimes desired to use the machine as a slitter for forming one elongated roll into two or more shorter rolls, a slitter roll shaft 78 is mounted in the frame 12 and is shown as supporting a pair of slitter discs 80 which may be selectively brought into engagement with the web 60 by moving the slitter actuator handle 82 from the upper slot 84 shown in FIG. 1 to the lower slot 86. Since the web 60 is backed up by the rotating anvil roll 68 in the region immediately underneath the slitter disc 80, it is obvious that cutting will take place when the paper is engaged.

Figure 4:
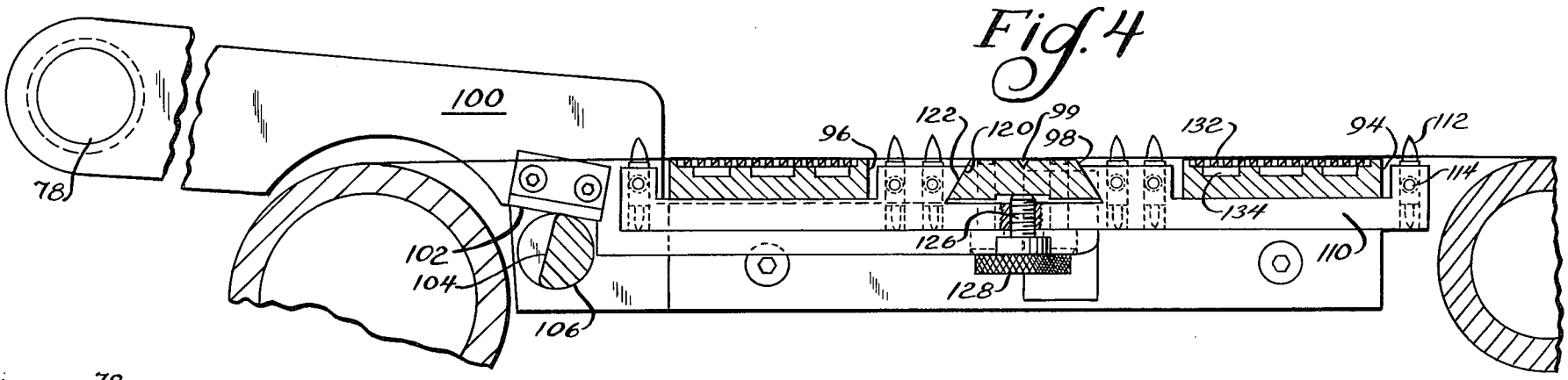
FIG. 4 is a side sectional view taken on line 4—4 on FIG. 1 and showing the pin bar portion of the splicing mechanism in its engaged position.
Figure 5:
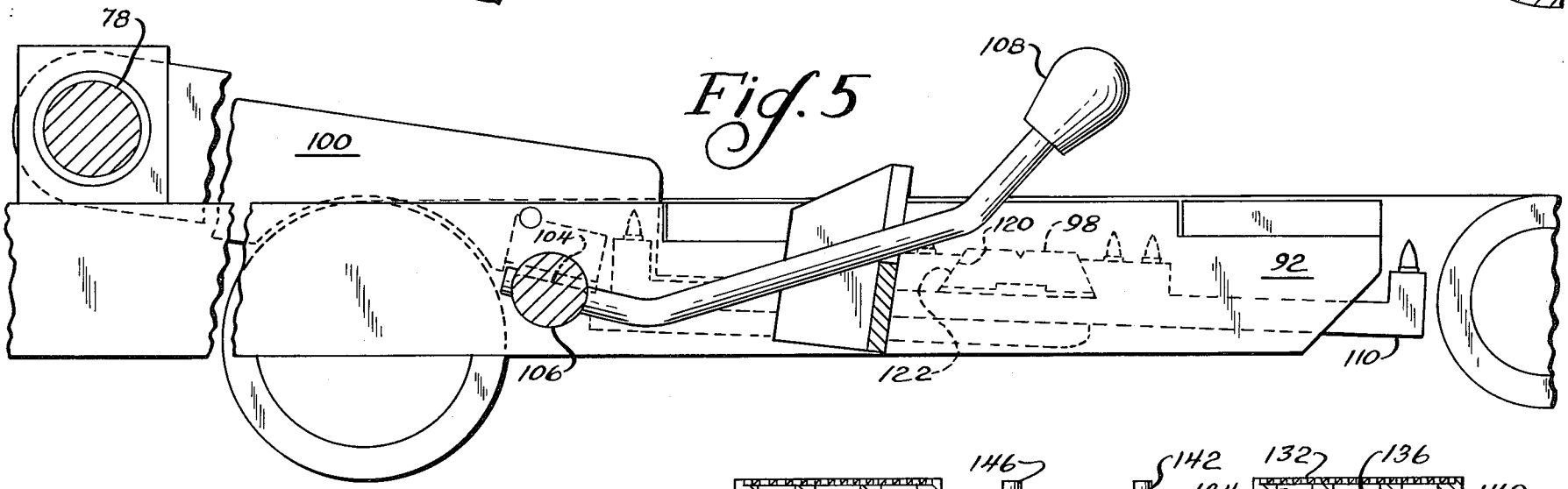
FIG. 5 is a side sectional view taken on line 5—5 of FIG. 1 and showing the pin bar portion of the splicing mechanism in its retracted position.

The principal feature of my invention is the splicer board assembly indicated generally at 90. The splicer board assembly includes an outboard frame member 92 which is supported at the end of shaft 78 and is affixed near its other end to the front and rear vacuum box members 94, 96 at their outer ends. The inner ends of the vacuum box members are affixed to the housing 12. A vertically movable splice bar 98 containing a longitudinal splicing notch 99 is carried by a pair of elongated pin bar support members 100 which are pivotally mounted on shaft 78. The pin bar support members 100 each carry a bracket or angle member 102 which is adapted to engage a cam surface 104 on shaft 106. The cam surfaces 104 comprise a pair of flat surfaces which are cut out of one side of the shaft 106. When the pin bar actuating handle 108 is moved counterclockwise from its FIG. 5 position, the cam surface 104 will be rotated to the position shown in FIG. 4 wherein it has lifted the bracket 102 and the pin bar support members 100 so as to cause the splice bar 98 to be lifted from its retracted dotted line position shown in FIG. 5 to its solid line position shown in FIG. 4. A pair of pin bars 110 are provided which are adapted to be longitudinally moved along the length of splice bar 98. The pin bars 110 are each shown as carrying six register pins 112 corresponding to the spacing of the holes 116 in the web 60 which are held in the pin bar by means of set screws 114. The register pins are shown as having their opposite ends of different diameters so that the diameter can be selected which is most appropriate for the diameter of the holes 116 in the particular paper web 60 being salvaged. In the disclosed embodiment of FIG. 1, only a single row of holes 116 is shown and thus the right-hand pin bar member 110 is not utilized. However, many forms have pin feed registration holes on both their edges and when such forms are being operated upon in the machine both of the pin bars 110 may be utilized. The pin bars are easily adjusted to any desired position along the length of the splice bar 98 by a dovetailed locking arrangement which comprises angled sides 120 on the pin bar and angled sides 122 on the splice bar. A locking screw 126 which is threadedly mounted in the pin bar has an enlarged hand-engageable head portion 128 which may be finger actuated to lock the pin bar in any desired position along the length of the splice bar.

Figure 6:
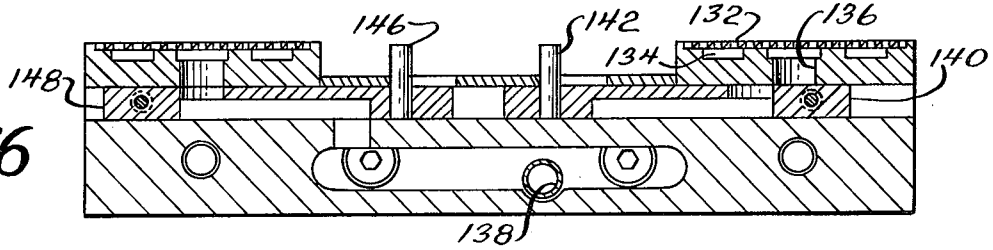
FIG. 6 is a side sectional view taken on line 6—6 of FIG. 1 showing the valves for controlling the flow of vacuum.

The vacuum boxes 94, 96 are each covered by perforated plates 132 which permit vacuum in the vacuum channels 134 to be applied to the underside of paper web 60. Depending upon the width of the web 60 being operated upon in the machine the exposed surfaces of the perforated plates 132 which are not underneath the web 60 are covered by pressure sensitive tape 135 or other covering material which will prevent any loss of vacuum. The vacuum in channels 134 is supplied by a vacuum inlet port 136 which is connected by a vacuum line 138 to a vacuum source such as a pump (not shown). A valve closure member 140 (FIG. 6) is actuated by the handle 142 to shut off the access of vacuum to inlet 136 when desired. The vacuum control handle 142 and the valve closure member 140 for front vacuum box 94 are shown in their closed position in FIG. 6 whereas the identical valve handle member 146 and valve closure member 148 for rear vacuum box 96 are shown in their open position.

Figure 3:
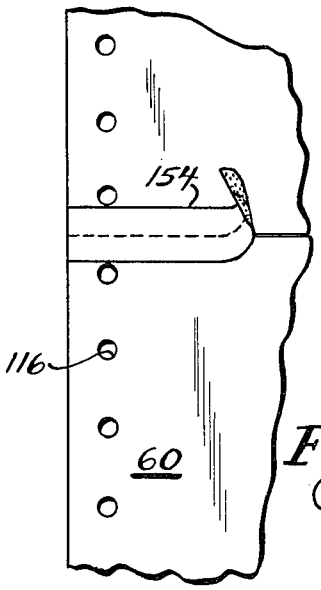
FIG. 3 is a top view of a spliced web showing the relationship of the splicing tape to the perforations in the web.

Referring to FIG. 1, a description of a splicing operation will be provided. Assuming the machine is running at speed so that paper is being unwound from supply roll 22 onto take-up roll 32, a printer's flag 58 falls out of the roll indicating to the operator that sub-standard or imperfect printing is coming. The operator will then dial down the speed control potentiometer 38 to stop the web 60 just at the start of the waste product. He will then raise the brake tension lever 52 and move the web either by hand or by the speed potentiometer 38 until the exact top of the last good form upstream of the take-up roll 32 is directly over the splicing groove 99. With his left hand, the operator will lift the handle 108 to raise the pin bar 110 so that the registration pins will just start to enter the holes 116 in the web 60. Meanwhile, the operator will use his right hand to either slightly rotate the roll 32 to loosen the tension on the paper or grab the paper and roll 70 and move the paper as necessary to permit the holes 116 to become perfectly registered with the registration pins 112 without causing any elongation of the holes 116. The pin bar control handle 108 is then released and left in its upward position shown in FIG. 1. The vacuum pump switch 150 (FIG. 2) is then actuated to turn on the vacuum pump (not shown). The front vacuum control handle 142 is then pushed to the right from the position shown in FIG. 6 so as to move the valve closure member 140 away from the vacuum inlet 146. This will permit vacuum to pass through the perforated surface 132 in the front vacuum box 194 and firmly hold the paper above it in a fixed position. A razor blade or other cutter 152 is then passed by the operator through the paper 60 and the slot 99 to sever the web and leave the portion which is attached to the supply roll 22 free. At this point the operator grabs the loose end of the web 60 and pulls paper off the supply roll 22 until the bad portions are all disposed of. He then aligns the register marks on the free end of roll 22 with the splice line and places the web down over the register pins 112 which are adjacent the rear vacuum box 96. The vacuum to the rear vacuum box which had been turned off is now turned on by moving vacuum control handle 146 to the position shown in FIG. 6. The razor blade 152 is then again run through the paper and the groove 99 to separate the good printing on roll 22 from the bad printing which had previously been pulled past the splice area. A length of narrow pressure sensitive tape 154 is then applied by the operator across the width of the web as shown in FIG. 3 to splice the free ends of the paper together. The tape 154 must be sufficiently narrow to avoid covering the holes 116. A width of 0.375 inches is generally sufficient for the tape for this purpose since the holes 116 are on 0.5 inch centers. The tape 154 shown in FIG. 3 is depicted as being perforated but the tape could also be unperforated. Preferably, when the forms being salvaged have already been perforated it is desirable to use perforated tape 154 and when the form is to be perforated later on the collator a plain tape can be used. Once the splice is completed, the vacuum pump is turned off or the vacuum control handles 142, 146 are moved to their most closely adjacent position to turn off the vacuum. At this time, the handle 108 is moved to the position shown in FIG. 5 to retract the pin bar 110 and registration pins 112 beneath the web. The machine may then be restarted to continue winding by first releasing the brake tension lever 52 for a short period and then engaging it and turning the motor speed up gradually until normal running speed is attained.

Although the vacuum boxes 94, 96 have been shown to be affixed to the frame 12, it is contemplated that they could also be an integral part of the splicing bar 98 such that they would be positioned on either side of the groove 99 and would, of course, be movable vertically with the bar. In such a construction, the vacuum lines will be flexible tubes.

I claim as my invention:

1. A machine for salvaging the usable portions of a roll of paper which has edge positioned pin-feed registration holes from a continuous supply roll of said paper containing both usable and unusable portions, said machine comprising a frame; first support shaft means mounted for rotation in said frame for supporting the core of said supply roll; second support shaft means mounted for rotation in said frame for supporting a take-up core about which the usable portions of said supply roll are to be wound; a pair of paper engaging guide rollers mounted in said frame with their axes spaced apart sufficiently so as to provide an extended straight line path for paper passing over their surfaces which is being unwound from one of said cores onto the other; splicing board means mounted on said frame and extending outwardly from said frame and normally just under said straight line path; said splicing board means including a pair of elongated spaced apart flat vacuum table portions which are positioned intermediate said pair of guide rollers; a source of vacuum; said table portions being selectively connected to said source of vacuum and having perforated top surfaces for permitting suction to be applied to spaced portions of said paper to selectively firmly affix said spaced portions to said perforated top surfaces; at least a pair of spaced register pins for longitudinally registering the registration holes on one edge of each of said spaced portions of paper, said register pins being mounted on a pin bar which is movable longitudinally relative to each of said table portions to adjust for different paper widths; splicing bar means including a splicing groove positioned between said table portions, said groove being adapted to receive a cutter for cutting said paper; and retractable support means for said pin bar and guide pins for selectively moving said guide pins upwardly through said straight line path when the paper in said path is to be cut or spliced.

2. The machine of claim 1 wherein said pin bar is slidably mounted on a splicing bar portion of said splicing bar means and extends transversely of the longitudinal axis of said splicing bar portion.

3. The machine of claim 2 wherein said pin bar and said splicing bar portion have cooperating dovetail side portions.

4. The machine of claim 3 wherein said pin bar has a screw member threadedly engaged therewith which underlies the splicing bar portion and can be forced thereagainst to firmly lock said cooperating dovetail side portions together.

5. The machine of claim 2 wherein said pin bar includes at least four spaced register pins, half of which are arranged on each of the opposite sides of said splicing groove.

6. The machine of claim 5 wherein said pin bar includes six spaced register pins.

7. The machine of claim 2 wherein said vacuum table portions are fixed in position relative to the machine frame on opposite sides of a splicing bar containing said splicing groove.

8. The machine of claim 1 wherein said retractable support means for said pin bar includes a pair of elongated pivoted arms and a hand actuable cam member which bears on said arms to lift them when desired.

9. The machine of claim 8 wherein a splicing bar portion of said splicing bar means is mounted between the movable end portions of said pair of pivoted arms.

10. The machine of claim 1 wherein a vacuum control valve is positioned near one end of each of said vacuum table portions.

11. The machine of claim 10 wherein said vacuum control valves are positioned so that they can be simultaneously manually actuated to cut off the flow of vacuum to each of said vacuum table portions.

* * * * *